US008508520B2

(12) United States Patent
Porwal

(10) Patent No.: US 8,508,520 B2
(45) Date of Patent: Aug. 13, 2013

(54) LUMINOUS POWER CONTROL OF A LIGHT SOURCE OF A MULTIMEDIA PROCESSING SYSTEM

(75) Inventor: Gunjan Porwal, Maharashtra (IN)

(73) Assignee: Nvidia Corporation, Santa Clara, CA (US)

( * ) Notice: Subject to any disclaimer, the term of this patent is extended or adjusted under 35 U.S.C. 154(b) by 710 days.

(21) Appl. No.: 12/499,800

(22) Filed: Jul. 9, 2009

(65) Prior Publication Data

US 2011/0006997 A1 Jan. 13, 2011

(51) Int. Cl.
*G09G 5/00* (2006.01)
*G09G 3/36* (2006.01)

(52) U.S. Cl.
USPC ..... 345/211; 345/102; 345/173; 382/118

(58) Field of Classification Search
USPC ..... 345/156–173, 102, 204, 211–212; 713/320–324; 382/117–118
See application file for complete search history.

(56) References Cited

U.S. PATENT DOCUMENTS

| | | | | |
|---|---|---|---|---|
| 2004/0175020 | A1* | 9/2004 | Bradski et al. | 382/103 |
| 2007/0075965 | A1* | 4/2007 | Huppi et al. | 345/156 |
| 2009/0052859 | A1* | 2/2009 | Greenberger et al. | 386/46 |
| 2009/0207121 | A1* | 8/2009 | Shih et al. | 345/102 |
| 2009/0309878 | A1* | 12/2009 | Otani et al. | 345/427 |
| 2010/0079508 | A1* | 4/2010 | Hodge et al. | 345/697 |
| 2010/0117949 | A1* | 5/2010 | Lai et al. | 345/102 |

* cited by examiner

*Primary Examiner* — Hong Zhou
(74) *Attorney, Agent, or Firm* — Raj Abhyanker, P.C.

(57) ABSTRACT

A method, apparatus, and system of luminous power control of a light source of a multimedia processing system are disclosed. In one embodiment, a method is described. The method includes capturing a digital image of a face of a user. The method also includes applying, with a processor, an algorithm capable of detecting a digital facial feature of the face of the user based on one or more markers of the digital image. In addition, the method includes determining whether the digital image includes the digital facial feature according to the marker. The method further includes causing a light source to illuminate an electronic display at an active-mode luminous power level that includes a luminous power level different than a power-saving mode luminous power level of the light source when the digital image includes the digital facial feature.

20 Claims, 8 Drawing Sheets

| LIGHT-SOURCE MODE 500 | PARAMETER 502 | PARAMETER 504 | PARAMETER 506 | PARAMETER 508 |
|---|---|---|---|---|
| ACTIVE MODE 510 | YES | NO | YES | NO |
| POWER-SAVING MODE 512 | NO | YES | NO | YES |

FIGURE 5

LUMINOUS POWER CONTROL OF A LIGHT SOURCE OF A MULTIMEDIA PROCESSING SYSTEM

FIELD OF TECHNOLOGY

This disclosure relates generally to multimedia technology, and, more particularly, to a system, an apparatus, and a method of a luminous power control of a light source of a multimedia processing system.

BACKGROUND

A light source (e.g. a backlight, a light emitting diode, a front light) of a display (e.g. a touch screen) of a multimedia processing system (e.g. a mobile device) may be in an active mode to enable a user to read a content on the display. The light source may consume battery power. Accordingly, the multimedia processing system may set the light source to a power-saving mode after a certain period of time to conserve power. The user may have difficulty reading the content when the light source is in the power-saving mode. The user may then need to perform an activation operation (e.g. tapping a key sequence) to reactivate the light source. The user may lose concentration when this occurs, and, consequently, productivity of the user may suffer.

SUMMARY

A method, system, and apparatus of luminous power control of a light source of a multimedia processing system are disclosed. In one aspect, a method includes capturing a digital image of a face of a user. The method also includes applying, with a processor, an algorithm capable of detecting a digital facial feature of the face of the user based a marker of the digital image. In addition, the method includes determining whether the digital image includes the digital facial feature according to the marker. The method further includes causing a light source to illuminate an electronic display at an active-mode luminous power level that is different than a power-saving mode luminous power level of the light source when the digital image includes the digital facial feature.

In addition, the method may include converting, with an image sensor, an optical image of the face of the user to the digital image representing the optical image. The electronic display may be located in a mobile device. The method may include instructing a light source driver to cause the light source to operate at the active-mode luminous power level when the digital image includes the digital facial feature. The method may also include instructing the light source driver to cause the light source to operate at the power-saving mode luminous power level when the digital image does not include the digital facial feature. The luminous power level of the power-saving mode luminous power level may be sufficient to maintain a data in a memory of the mobile device.

In addition, the method may include setting a time period calculated by a light timer to an initial value when the digital image includes the digital facial feature. The electronic display may include a touch screen. The method may also include capturing the optical image from an area substantially parallel to a plane of the electronic display. The active-mode luminous power level may be sufficient for the user to ascertain a content presented on the display. The user may set the active-mode luminous power level.

In another aspect, a multimedia processing system includes an image sensor to convert an optical image to a digital image. The system also includes a facial detection module to determine whether the digital image includes a digital facial feature. The facial detection module is communicatively coupled to the image sensor. The system also includes a processor, an electronic display, a light source to illuminate the electronic display, and a light-source driver to cause the light source to illuminate the electronic display at an active-mode luminous power level when the digital image includes the digital facial feature. The light-source driver may be communicatively coupled with the facial detection module.

The facial detection module may analyze the digital image with a facial detection algorithm. The multimedia processing system may include a mobile device. The image sensor may acquire the optical image at a periodic interval when the light source is in an active-mode. The image sensor may acquire the optical image from an area substantially parallel to a plane of the electronic display.

In yet another aspect, a method includes acquiring, with a digital camera of a mobile device, an image from an area substantially parallel to a display screen of the mobile device. In addition, the method includes detecting a face of a user in the image. The method also includes illuminating the display screen when the face of the user is detected in the image.

In addition, the method may include illuminating the display screen at an illumination level sufficient to aid the user while viewing a content of the display screen when the face of the user is detected in the image. The method may also include illuminating the display screen at a power-saving level when the face of the user is not detected in the image. The power-saving level may be different than the illumination level.

The system, apparatus and method disclosed herein may be implemented in any means for achieving various aspects, and may be executed in a form of a machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which:

FIG. 5 is a table view illustrating a relationship between a light-source mode and a set of parameters, according to one embodiment.

Other features of the present embodiments will be apparent from the accompanying drawings and from the detailed description that follows.

DETAILED DESCRIPTION

Disclosed are a several methods and a system of luminous power control of a light source of a multimedia processing system. Examples of multimedia processing systems include, but are not limited to, a mobile communication device, a smart phone, a personal computer, a personal digital assistant and a mobile communication system (e.g. a mobile phone). Although the present embodiments have been described with reference to specific example embodiments, it will be evident that various modifications and changes may be made to these embodiments without departing from the broader spirit and scope of the various claims.

Figure 1:
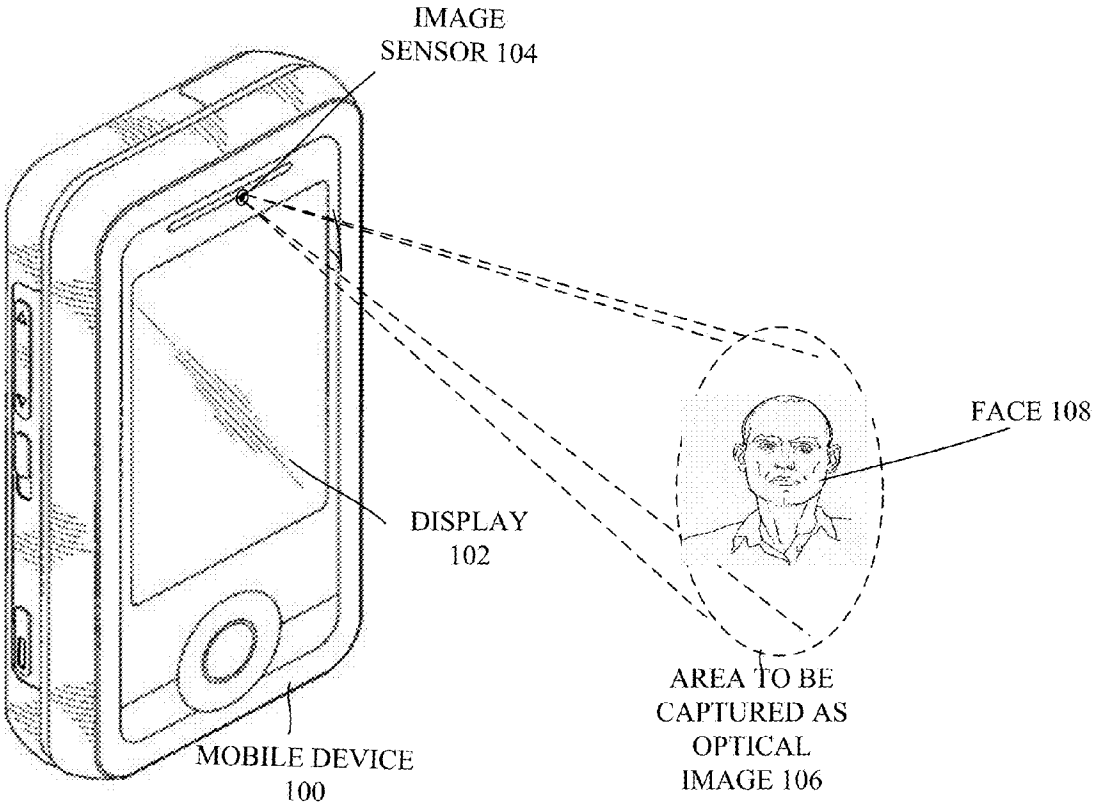
FIG. 1 is a schematic diagram a mobile device acquiring an optical image, according to one embodiment.

FIG. 1 illustrates, in part, a schematic diagram of a mobile device according to one embodiment. The plane of the face 108 of the user may be substantially parallel to the plane of the surface of the display 102 of the mobile device 100. An image sensor 104 (e.g. a digital camera) may be located in the mobile device 100. According to one embodiment, the image sensor can be a front-facing video capture device. An aperture of the image sensor 104 may share a common surface plane with the display 102. The view of the image sensor 104 may be oriented outwards from the mobile device 100 in a substantially perpendicular manner with respect to the plane of the display 102. The image sensor 104 may capture an optical image 106 of a face 108 of a user from an area substantially parallel to the plane of the display 102. In an example embodiment, the image sensor 104 may automatically capture an optical image 106 of the face 108 at a pre-determined period if the display 102 is in an active mode (e.g. illuminated at an active-mode luminous power level). The image sensor 104 may then convert the optical image 106 into a digital image. The digital image may be a representation of a two-dimensional optical image in binary code.

The display 102 provides content (e.g. graphical icons, email messages, telephone numbers, newspaper articles) to the user. In an example embodiment, the display 102 may be a touch screen. The display 102 includes a light source to aid the user in reading the content on the display 102 in certain ambient light conditions (e.g. in a dark room, at night).

Figure 2:
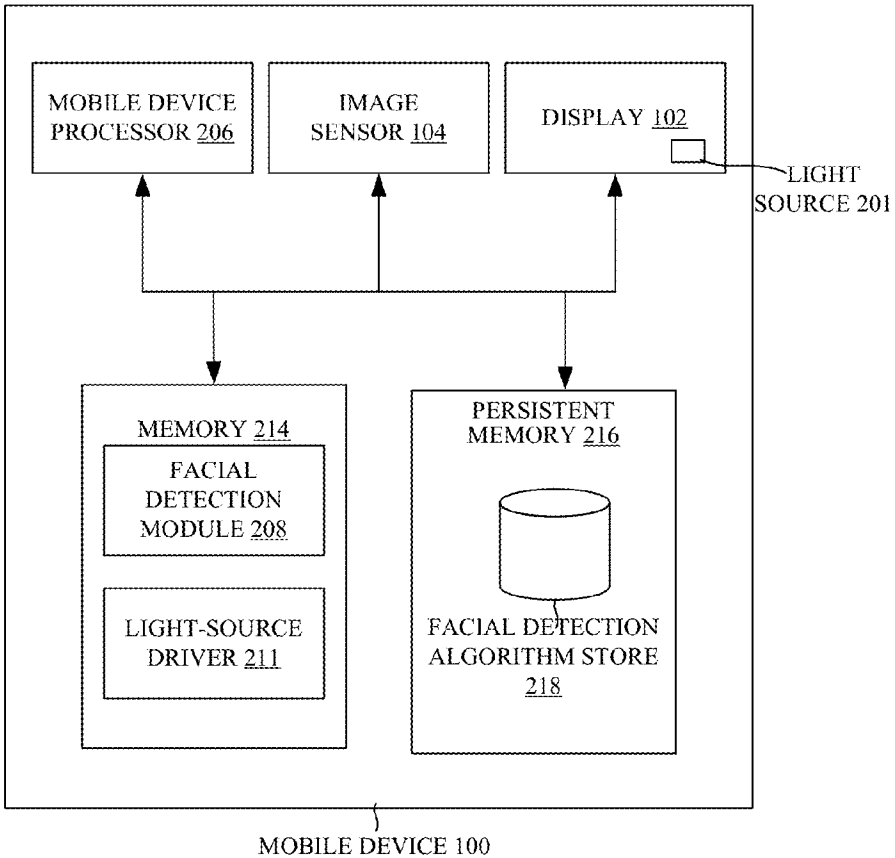
FIG. 2 is a block diagram of the mobile device processing the optical image, according to one embodiment.

FIG. 2 illustrates a block diagram of the mobile device 100, according to one embodiment. The image sensor 104 provides the digital image. The processor 206 may cause the digital image to be stored in the memory 214. The processor 206 may be a mobile device processor. In one embodiment, the memory 214 may be a type of random access memory (e.g. RAM, dynamic RAM, flash drive) used to store data.

The memory 214 includes a facial detection module 208. The facial detection module 208 may determine whether the digital image includes a digital facial feature (e.g. an optical image of a facial feature represented in a numeric code). The facial detection module 208 may apply a particular facial detection algorithm to the digital image. The facial detection module 208 may issue a set of facial detection algorithm instructions to the mobile device processor 206. The mobile device processor 206 may then execute the facial detection algorithm on the digital image. The facial detection module 208 may instruct the light-source driver 211 to set the light source 201 to operate in an active-mode when the digital image includes the digital facial feature. The light source 201 may remain in the active-mode until another instruction is received from the light-source driver 211.

The light source 201 may be any device that illuminates the display 102 to enable the user to read the content of the display 102. For example, in one embodiment, the display 102 may include a backlight of liquid crystal display (LCD) panel.

The luminous power level of the light source 201 may be a function of the power provided to the light source 201 by a power source (e.g. a battery) of the mobile device 100. The luminous power level of the light source 201 may be modulated according to various modes of the display 102. For example, the light source 201 may receive more power when operating in an active-mode than when operating in a power-saving mode. In one embodiment, an active-mode luminous power level may be a luminous power level sufficient for a user to read a content of the display 102. A power-saving mode luminous power level may be a luminous power level sufficient to maintain information and data present in the memory 314 (e.g. if the memory 314 is a volatile form of memory) of the mobile device 100 while conserving the resources of the power source.

The light-source driver 211 may be provide a set of instruction to the processor so that it may properly interact with the light source 201. Particularly, the light-source driver 211 may include a set of commands that allows the facial detection module 208 and/or an operating system of the mobile device 100 to interact with the hardware of the light source 201. The light-source driver 211 may reside in the memory 314.

The facial detection module 208 may periodically determine whether the light source 201 is operating in the active-mode. If the light source 201 is in the active-mode, the facial detection module 208 may then instruct the image sensor 104 to periodically capture the optical image 106 from the area substantially parallel to the plane of the display 102. The facial detection module 208 may analyze each periodically captured digital image to determine whether the digital image includes the digital facial feature. The facial detection module 208 may instruct the light-source driver 211 to set the light source 201 in the power-saving mode when the facial detection algorithm determines that the digital image does not include the digital facial feature. The light-source driver 211 may then set the light source 201 to operate in the power-saving mode.

The facial detection algorithm may be set of instructions used by the facial detection module 208 to identify a digital facial feature according to a particular marker. For example, the facial detection algorithm may include comparing the digital image to a facial feature database. The facial feature database may be stored in the facial detection algorithm store 218. The facial detection module 208 may determine a match between a portion of the digital image and a facial feature of the facial feature database. In one embodiment, the range of parameters that define the facial feature may be generic to the genus of humans. For example, the range of parameters of the facial detection algorithm may be defined sufficiently broad enough to detect a wide variety of human faces.

In various embodiments, example facial detection algorithms that may be used by the facial detection module 208 include, but are not limited to, principal component analysis (PCA) algorithms, independent component analysis (ICA) algorithms, linear discriminant analysis (LDA) algorithms, Evolutionary Pursuit (EP) algorithms, Elastic Bunch Graph Matching (EBGM) algorithms, kernel method algorithms, trace transform algorithms, active appearance model (AAM) algorithms, three-dimensional morphable model algorithms, three-dimensional facial detection algorithms, Bayesian framework algorithms, support vector machine (SVM) algorithms, and hidden Markov models (HMM) algorithms.

The memory 214 may include an operating system. The operating system may serve as an interface between the software functionalities and the hardware devices of the mobile device. The mobile device of FIG. 2 also includes a persistent memory 216 as illustrated in the block diagram of the mobile device 100. In one embodiment, the persistent memory 216 may be a non-volatile memory (e.g. a flash drive). The persistent memory 216 may include a facial detection algorithm store 218. The facial detection algorithm store 218 may persistently store the data and instructions of the facial detection module 208 (e.g. facial detection algorithms, facial pose data).

Figure 3:
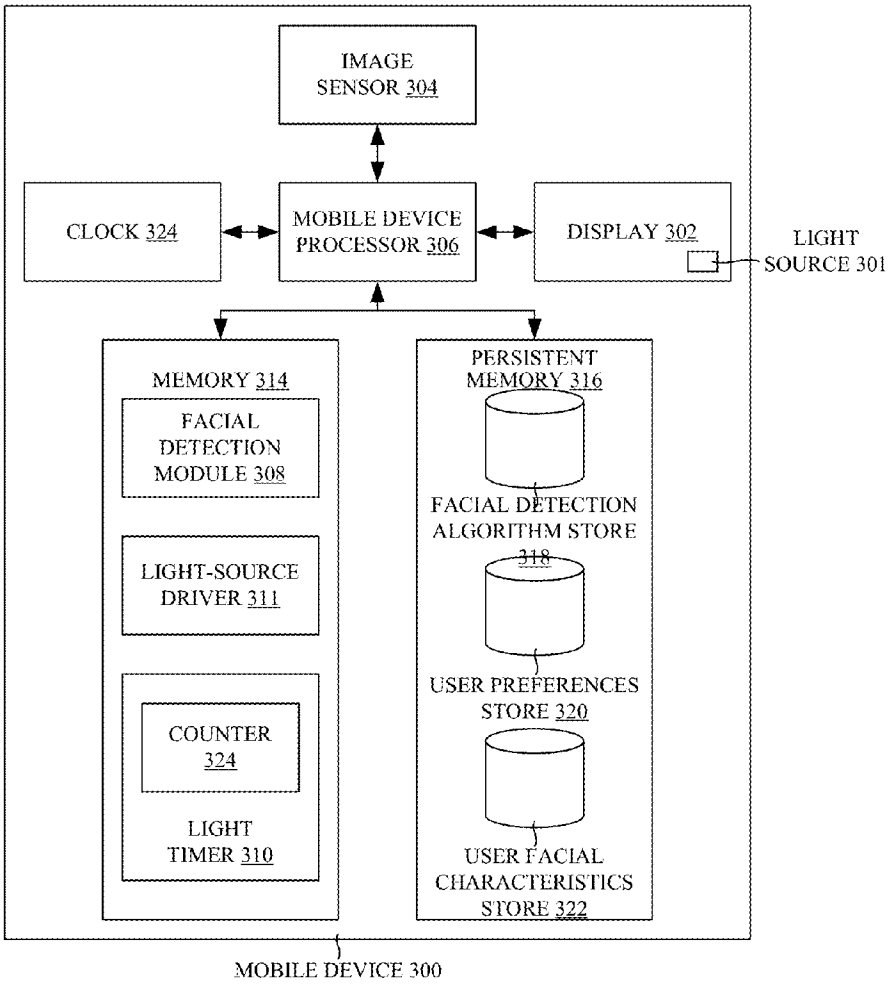
FIG. 3 is a block diagram of a mobile device having a light timer and counter, according to one embodiment.

FIG. 3 illustrates a block diagram of a mobile device 300 having a light timer 310 and a counter 324, according to one embodiment. The image sensor 304 may capture the optical image 106 and convert the optical image 106 to a digital image. The facial detection module 308 may analyze the digital image with a facial detection algorithm to detect a digital facial feature. The facial detection algorithm may be stored in the facial detection algorithm store 318 of the persistent storage 316. The facial detection module 308 may instruct the light timer 310 to set the counter 326 to an initial value when the digital image includes a digital facial feature. The light timer 310 may include a counter 326 to measure a period according to a clock signal from a counter 324. The facial detection module 308 may also instruct the light-source driver 311 to set the light source 301 in the active-mode. When the counter 326 reaches a final value, the light timer 310 may instruct the light-source driver 311 to set the light source 301 to the power-saving mode.

The image sensor 304 may continue to periodically capture digital images of the area substantially parallel to the planar surface of the display 302 as long as the light source 301 is in the active mode. The facial detection module 308 may continue to instruct the light timer 310 to reset the counter 326 to an initial value each time a digital facial feature is detected by the facial detection module 308. Accordingly, the light source 301 may continue to operate at the active-mode luminous power level as long as the counter 326 continues to be reset by the light timer 310. However, the counter 326 may not be reset if the facial detection module 308 does not detect a digital facial feature. Consequently, the counter 326 may eventually reach the final value. The light-source driver 311 may then set the light source 301 to the power-saving mode.

In the other example embodiment, the persistent memory 316 may include a user preferences store 326 to persistently store various user preference data (e.g. period of time calculated by counter 326 of light timer 310). The persistent memory 322 may include a user facial characteristics store 322 to store a set of facial characteristics data of a particular user (e.g. the user). In certain embodiments, the facial detection module 308 may use the facial characteristics data to identify a particular face. A particular set of user preferences may be applied when the facial detection module 308 identifies the particular face. The user preferences may be stored in the user preferences store 320.

Figure 4:
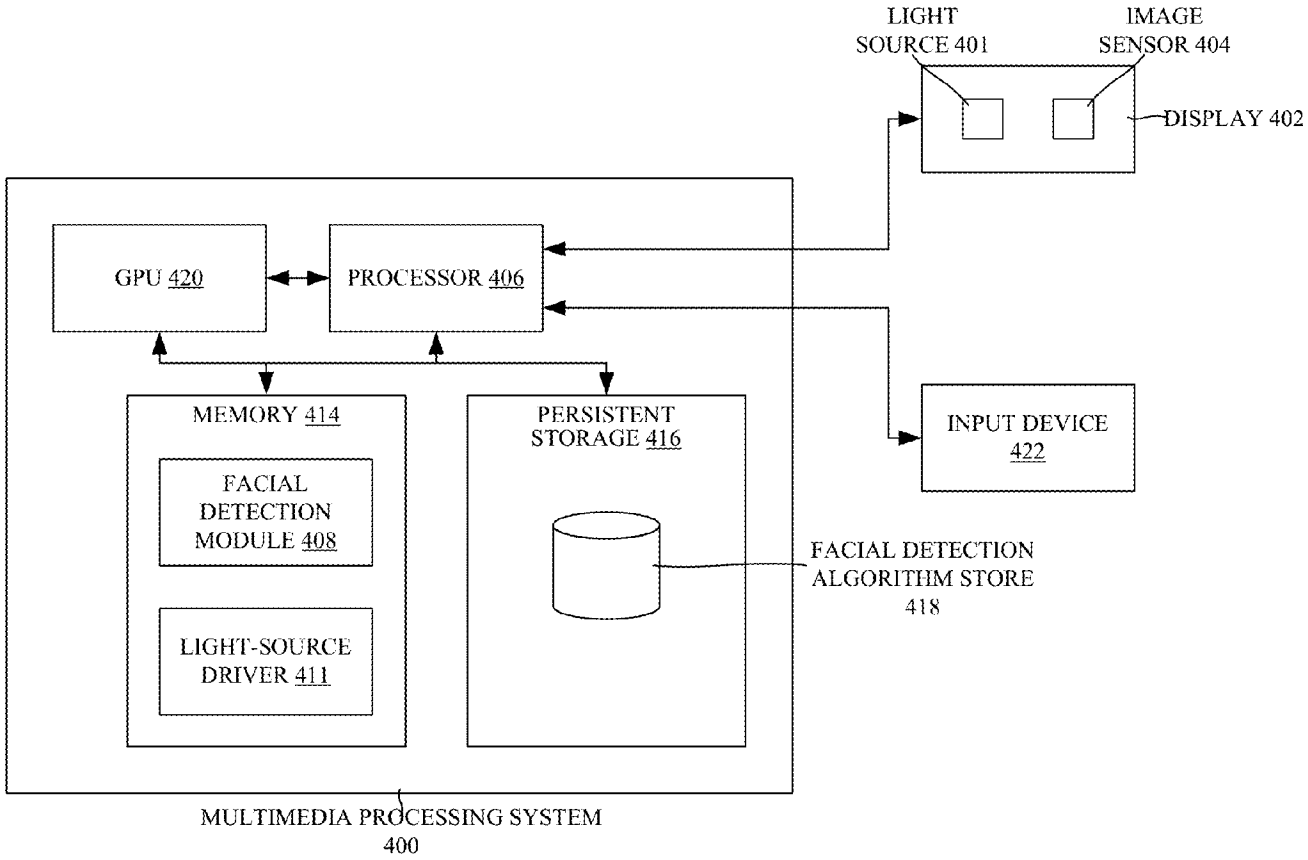
FIG. 4 is a block diagram of a multimedia processing system, according to one embodiment.

FIG. 4 illustrates a block diagram of a multimedia processing system 400, according to yet another example embodiment. The multimedia processing system 400 may be coupled with a display 402. In one embodiment, the multimedia processing system 400 may be a laptop or desktop computer. The display may include and/or may be communicatively coupled to an image sensor 404. The image sensor 404 may be configured to capture an optical image 106 of an area substantially parallel to the display 402. The image sensor 404 may convert the optical image 106 to a digital image. The memory 414 may include a facial detection module 408. The facial detection module 408 may use a facial detection algorithm to detect the digital facial feature in the digital image. The facial detection module 408 may instruct the light-source driver 411 to set the light source 401 of the display 402 to an active mode when a digital facial feature is detected in the digital image.

The facial detection algorithm may be stored in the facial detection algorithm store 418 of the persistent storage 416. The facial detection module 408 may instruct the image sensor 404 to periodically capture an optical image 106 when the graphics processing unit 420 is processing graphics applications. The processor 406 may decode the digital image and then store the digital image into the memory 414. The processor 406 may be a multimedia processor.

FIG. 5 is a table view illustrating a relationship between a light-source mode 500 and a set of parameters 502-508, according to certain example embodiments. Parameters 502-508 may be used to define the light-source mode 500. For example, the parameter 502 may be satisfied when a digital facial feature is detected in a digital image. The digital image may digitally represent an optical image 106 acquired by the image sensor 104. The facial detection module 208 may detect the digital facial feature. The light-source mode 500 may be set to the active mode 510 when parameter 502 is satisfied. Parameter 504 may be satisfied when a digital facial feature is not detected in the digital image. The light-source mode 500 may be set to the power-saving mode 512 when parameter 504 is satisfied. Parameter 506 may be satisfied when a counter 326 of the light timer 310 is not at a final value. The light-source mode 500 may be set to the active mode 510 when parameter 506 is satisfied. Parameter 508 may be satisfied when the counter 326 is at the final value. The light-source mode 500 may be set to the power-saving mode 512 when parameter 508 is satisfied.

Figure 6:
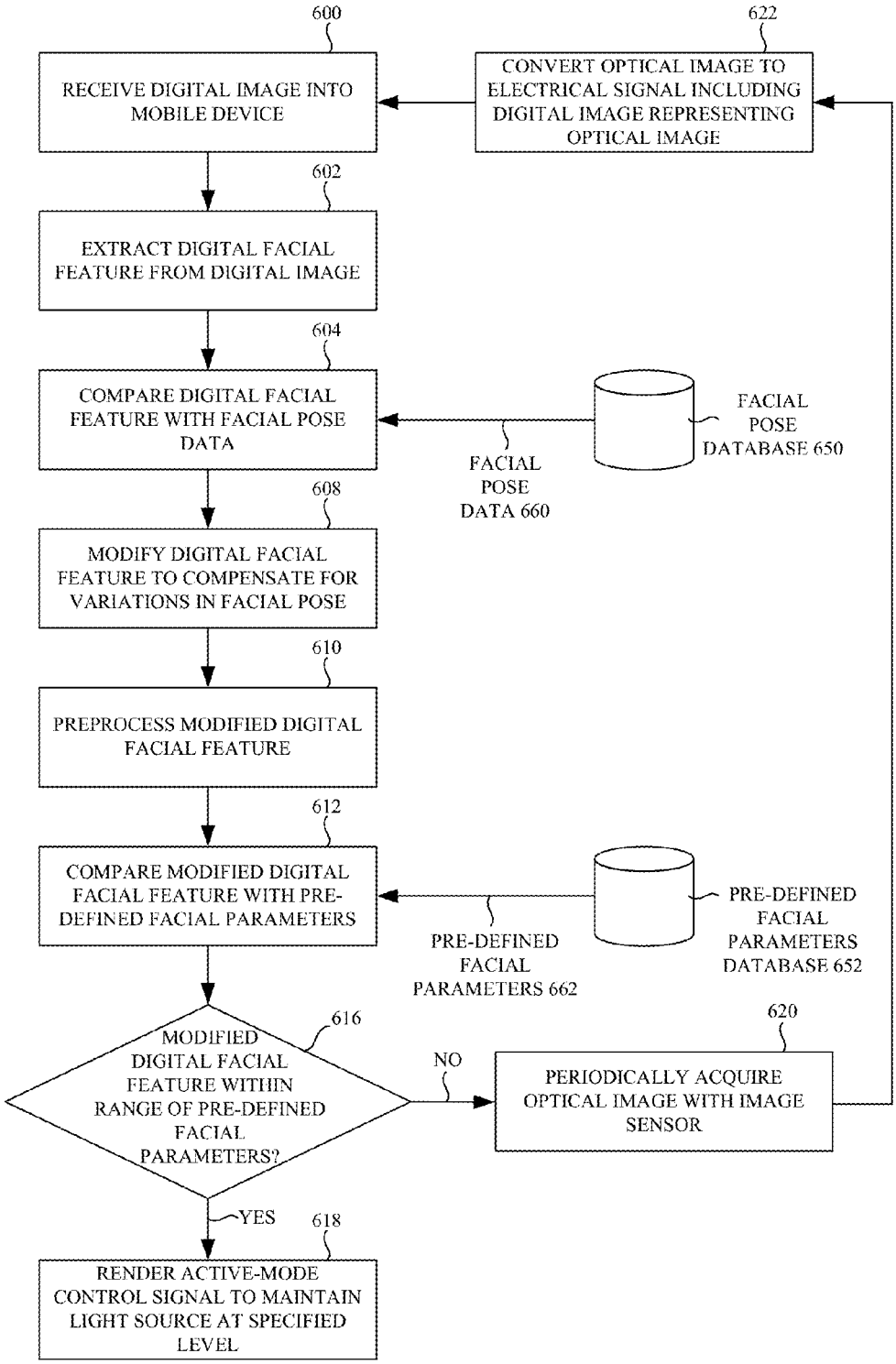
FIG. 6 is a flow chart illustrating controlling a light source of a mobile device, according to one embodiment.

FIG. 6 is a flow chart illustrating controlling a light source of a mobile device, according to one example embodiment. In operation 600, a digital image may be received by the mobile device 100. In operation 602, the digital facial feature may be extracted from the digital image. The facial detection module 208 may include a set of instructions for extracting the digital facial feature. In operation 604, the digital facial feature may be compared with a set of facial pose data. The facial pose data 660 in a facial pose data database 650 may be used in operation 604. In operation 608, the digital facial feature may be modified to compensate for variations in facial pose.

In operation 610, the modified digital facial feature may be preprocessed. In operation 612, the modified digital facial feature of operation 610 may be compared with pre-defined facial parameters 662 stored in a pre-defined facial parameters database 652. In operation 616, the facial detection algorithm may determine whether the modified digital facial feature of the operation 610 is within the range of pre-defined parameters stored in the pre-defined facial parameters database 652.

In operation 618, an active-mode control signal may be rendered to maintain the light source 201 at an active-mode luminous power level if the modified digital facial feature is within the range of pre-defined parameters. In operation 620, the optical image 106 may be periodically acquired by the image sensor 104. In operation 622, the optical image 106 may be converted to an electrical signal including another digital image representing the optical image 106. The operations 600-616 may be repeated if the light source 201 is in active-mode. The facial pose data in the facial pose database 650 and the pre-defined facial parameters may be included in the facial detection algorithm store 218. In one embodiment, the structures of FIG. 2 may be used to perform operations 600-620. Particularly, the facial detection module 208 may include a set of instructions for operations 600-616. In yet another example embodiment, the structures of FIG. 4 may be used to perform operations 600-620.

Figure 7:
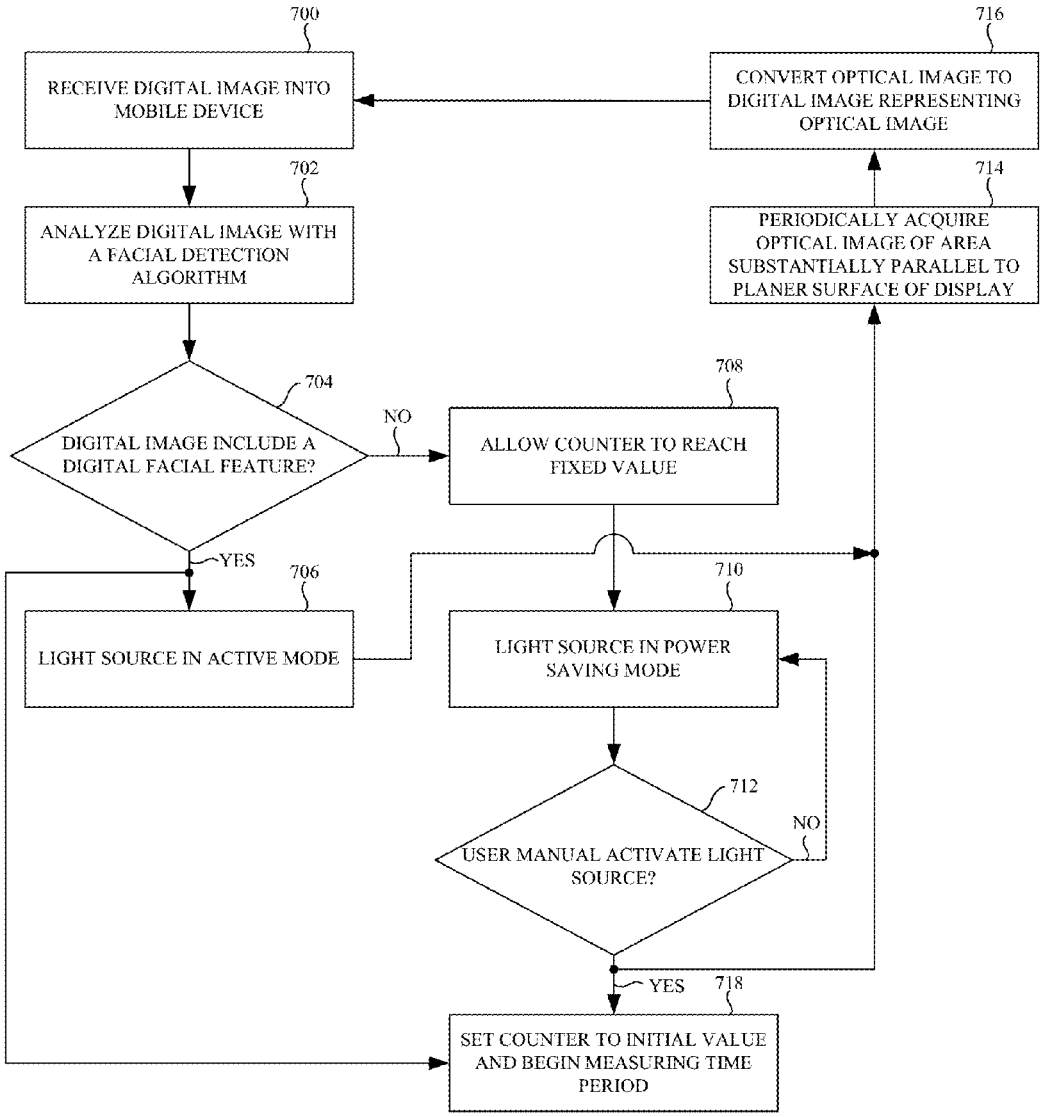
FIG. 7 is a flow chart illustrating controlling a light source of an electronic display, according to one embodiment.

FIG. 7 is a flow chart illustrating controlling a 301 of an electronic display, according to another example embodiment. In operation 700, a digital image is input into the mobile device processor 306. In operation 702, the digital image is analyzed using a facial detection algorithm. In operation 704, the digital image may be determined to include a digital facial feature. The light source 301 may be kept in active-mode in operation 706 when the digital image includes a digital facial feature. The counter 326 may be set to initial value and time period measurement is (re)started in operation 718. Further, in operation 714 the optical image 106 of the area substantially parallel to planar surface of display 302 may be periodically acquired. In operation 716, the optical image 106 may be converted to a digital image representing the optical image 106. Operations 700-704 may be repeated as long as the 301 remains in an active-mode.

In operation 708, the counter 326 may be allowed to reach final value if the digital image does not include a digital facial feature in operation 704. In operation 710, the light source 301 can be maintained in a power-saving mode. In operation 712, it may be determined whether a user manually activates the display 302. Operations 710-712 may be repeated if the user does not manually activate the display 302. If the user manually activates the display 302, then operations 714-716 may be executed, operations 700-712 may be repeated and also operation 718 may be performed. In operation 718, the counter 326 may be set to initial value and counting the time period is started. In one embodiment, the structures of FIG. 3 may be used to perform operations 700-718. In yet another example embodiment, the structures of FIG. 4 may be used to perform operations 700-718.

Figure 8:
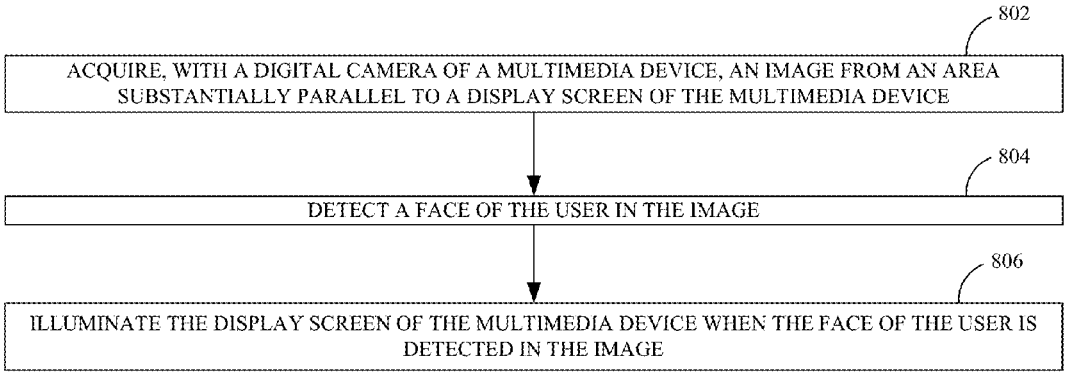
FIG. 8 is a process flow illustrating a method of illuminating a mobile device display, according to one embodiment.

FIG. 8 is a process flow illustrating a method of illuminating a mobile device display, according to a particular embodiment. In operation 802, an image may be acquired from an area substantially parallel to the surface plane of a display screen (e.g. the display 102) of the mobile device 100. In operation 804, a face of the user (e.g. the user) may be detected in the image. For example, the facial detection module 208 may detect the face of the user. In operation 806, the display screen may be illuminated when the face of the user is detected in the image. The light source 201 may illuminate the display screen. The display screen may be illuminated at an illumination level sufficient to aid a user examining (e.g. reading, viewing) a content of the display screen when the face is detected in the image.

Although the present embodiments have been described with reference to specific example embodiments, it will be evident that various modifications and changes may be made to these embodiments without departing from the broader spirit and scope of the various embodiments. For example, the various devices, modules, etc. described herein may be enabled and operated using hardware circuitry (e.g., CMOS based logic circuitry), firmware, software or any combination of hardware, firmware, and software (e.g., embodied in a machine readable medium).

In addition, it will be appreciated that the various operations, processes, and methods disclosed herein may be embodied in a machine-readable medium and/or a machine accessible medium compatible with a data processing system (e.g., a computer system), and may be performed in any order (e.g., including using means for achieving the various operations). Accordingly, the specification and drawings are to be regarded in an illustrative rather than a restrictive sense.

What is claimed is:

1. A method comprising:

verifying, through execution of a facial detection module stored in a memory communicatively coupled to a processor, whether an electronic display is illuminated by a light source at an active-mode luminous power level that is higher than a power-saving mode luminous power level thereof;

periodically capturing, solely when the electronic display is verified to be at the active-mode luminous power level, a digital image of a face of a user, wherein the digital image does not require user intervention for the periodic capturing thereof;

applying, with the processor, an algorithm associated with the facial detection module capable of detecting a digital facial feature of the face of the user based on a marker of the digital image;

determining whether the periodically captured digital image comprises the digital facial feature according to the marker;

maintaining the electronic display at the active-mode luminous power level when the periodically captured digital image comprises the digital facial feature;

resetting, through the processor, a counter to an initial count value whenever the periodically captured digital image is determined to include the digital facial feature;

allowing the counter to reach a final value thereof when the periodically captured digital image is determined to not include the digital facial feature;

transitioning the electronic display to the power-saving mode luminous power level of the light source when the periodically captured digital image is determined to not include the digital facial feature; and maintaining the electronic display at the power-saving mode luminous power level of the light source when the periodically captured digital image does not include the digital facial feature until the user manually activates the electronic display.

2. The method of claim 1, further comprising:

converting, with an image sensor, an optical image of the face of the user to the digital image.

3. The method of claim 2, further comprising:

periodically capturing the optical image from an area substantially parallel to a plane of the electronic display.

4. The method of claim 3, comprising providing a capability to the user to set the active-mode luminous power level.

5. The method of claim 1, wherein the electronic display is located in a mobile device.

6. The method of claim 1, further comprising:

instructing a light source driver to cause the light source to operate at the active-mode luminous power level when the periodically captured digital image comprises the digital facial feature.

7. The method of claim 6, further comprising:

instructing the light source driver to cause the light source to operate at the power-saving mode luminous power level when the periodically captured digital image does not comprise the digital facial feature.

8. The method of claim 1, comprising enabling the power-saving mode luminous power level to be sufficient to maintain the data in a memory of the mobile device.

9. The method of claim 1, wherein the processor is part of a mobile device.

10. The method of claim 1, wherein the electronic display comprises a touch screen.

11. The method of claim 1, comprising enabling the active-mode luminous power level to be sufficient for the user to ascertain a content presented on the electronic display.

12. The method of claim 1, wherein a machine is caused to perform the method of claim 1 when a set of instructions in a form of a non-transitory machine-readable medium is executed by the machine.

13. A multimedia processing system comprising:

an image sensor to periodically capture a digital image of a face of a user of the multimedia processing system, the digital image not requiring user intervention for the capturing thereof;

a memory;

a processor;

an electronic display;

a light source;

a facial detection module stored in the memory and configured to execute through the processor to: determine whether the periodically captured digital image comprises a digital facial feature, verify whether the electronic display is illuminated by the light source at an active-mode luminous power level that is higher than a power-saving mode luminous power level thereof, and to enable the periodic capturing of the digital image of the face of the user solely when the electronic display is verified to be at the active-mode luminous power level;

a light-source driver to cause the light source to illuminate the electronic display at an active-mode luminous power level when the periodically captured digital image comprises the digital facial feature and to maintain the electronic display at a power-saving mode luminous power level of the light source when the periodically captured digital image does not include the digital facial feature until the user manually activates the electronic display, wherein the light-source driver is communicatively coupled with the facial detection module, wherein the active-mode luminous power level is higher than the power-saving mode luminous power level, and wherein the processor is configured to execute instructions to: reset a counter to an initial count value when the periodically captured digital image includes the digital facial feature, prevent the resetting of the counter to the initial count value to enable the counter to reach a final value thereof when the periodically captured digital image does not include the digital facial feature, and transition the electronic display to the power-saving mode luminous power level of the light source when the periodically captured digital image is determined to not include the digital facial feature.

14. The multimedia processing system of claim 13, wherein the facial detection module analyzes the digital image with a facial detection algorithm.

15. The multimedia processing system of claim 13, wherein the multimedia processing system comprises a mobile device.

16. The multimedia processing system of claim 13, wherein the power-saving mode luminous power level is sufficient to maintain information and data in a memory of the multimedia processing system.

17. The multimedia processing system of claim 13, wherein the image sensor periodically captures the digital image from an area substantially parallel to a plane of the electronic display.

18. A method comprising:

verifying, through execution of a facial detection module stored in a memory communicatively coupled to a processor of a mobile device, whether a display screen of the mobile device is illuminated by a light source at an active-mode luminous power level that is higher than a power-saving mode luminous power level thereof;

periodically acquiring, with a digital camera of a mobile device, an image from an area substantially parallel to the display screen of the mobile device solely when the display screen is verified to be at the active-mode luminous power level, wherein the image does not require user intervention for the periodic acquisition thereof;

detecting a face of a user in the image;

maintaining the display screen at the active-mode luminous power level whenever the face of the user is detected in the image;

resetting, through the processor, a counter to an initial count value when the periodically acquired image includes the face of the user;

allowing the counter to reach a final value thereof when the periodically acquired image does not include the face of the user; and maintaining the display screen at the power-saving mode luminous power level when the face of the user is not detected in the image until the user manually activates the display screen.

19. The method of claim 18, further comprising:

illuminating the display screen at an illumination level sufficient to aid the user while viewing a content of the display screen when the face of the user is detected in the image.

20. The method of claim 18, further comprising:

illuminating the display screen at the power-saving mode luminous power level when the face of the user is not detected in the image.

* * * * *